US009821976B2

(12) United States Patent
Vonderheiden

(10) Patent No.: US 9,821,976 B2
(45) Date of Patent: Nov. 21, 2017

(54) APPARATUS FOR INFLUENCING A RUNNING MATERIAL WEB

(71) Applicant: TEXMAG GmbH Vertriebsgesellschaft, Thalwil (CH)

(72) Inventor: Jorg Vonderheiden, Bargteheide (DE)

(73) Assignee: TEXMAG GMBH VERTRIEBSGESELLSCHAFT, Thalwil (CH)

( * ) Notice: Subject to any disclaimer, the term of this patent is extended or adjusted under 35 U.S.C. 154(b) by 523 days.

(21) Appl. No.: 13/801,639

(22) Filed: Mar. 13, 2013

(65) Prior Publication Data

US 2013/0248634 A1 Sep. 26, 2013

(30) Foreign Application Priority Data

Mar. 20, 2012 (DE) ..... 10 2012 005 439

(51) Int. Cl.
*B65H 23/04* (2006.01)
*B65H 23/038* (2006.01)

(52) U.S. Cl.
CPC ..... *B65H 23/048* (2013.01); *B65H 23/038* (2013.01); *B65H 23/044* (2013.01); *B65H 2511/216* (2013.01); *B65H 2511/232* (2013.01); *B65H 2557/24* (2013.01); *B65H 2557/266* (2013.01)

(58) Field of Classification Search
CPC B65H 23/038; B65H 23/0324; B65H 23/048; B65H 23/044; B65H 23/192; B65H 23/1888; B65H 23/26; B65H 2557/24; B65H 2557/266; B65H 2301/443243; B65H 2404/15212; B65H 2511/232; B65H 2511/216
See application file for complete search history.

(56) References Cited

U.S. PATENT DOCUMENTS

| | | | |
|---|---|---|---|
| 3,300,114 | A | 1/1967 | Jacobsen |
| 4,069,959 | A | 1/1978 | Bartell et al. |
| 4,316,587 | A | 2/1982 | Gauthier |
| 5,555,611 | A | 9/1996 | Lyczek |
| 5,558,263 | A | 9/1996 | Long |
| 2001/0040178 | A1 | 11/2001 | Scharschinger et al. |
| 2005/0002718 | A1* | 1/2005 | Winter et al. ..... 400/579 |

FOREIGN PATENT DOCUMENTS

| | | | |
|---|---|---|---|
| DE | 1198162 | B | 8/1965 |
| GB | 938128 | A | 10/1963 |
| JP | H06271162 | A | 9/1994 |
| WO | 2011066133 | A1 | 6/2011 |

* cited by examiner

*Primary Examiner* — Michael C McCullough
(74) *Attorney, Agent, or Firm* — Epstein Drangel LLP; Robert L. Epstein

(57) ABSTRACT

An apparatus (1) serves to influence a running material web (2). To this end, the apparatus (1) has at least one adjustable roller (4), which deflects the material web (2). In order to improve the web running characteristics of the material web (2), the at least one roller (4) is adjustable by at least two degrees of freedom. Moreover, the at least one roller (4) is operatively connected to at least two actuators (17) such that at least one of the actuators (17) is assigned to each of the degrees of freedom.

6 Claims, 4 Drawing Sheets

APPARATUS FOR INFLUENCING A RUNNING MATERIAL WEB

Figure 1:
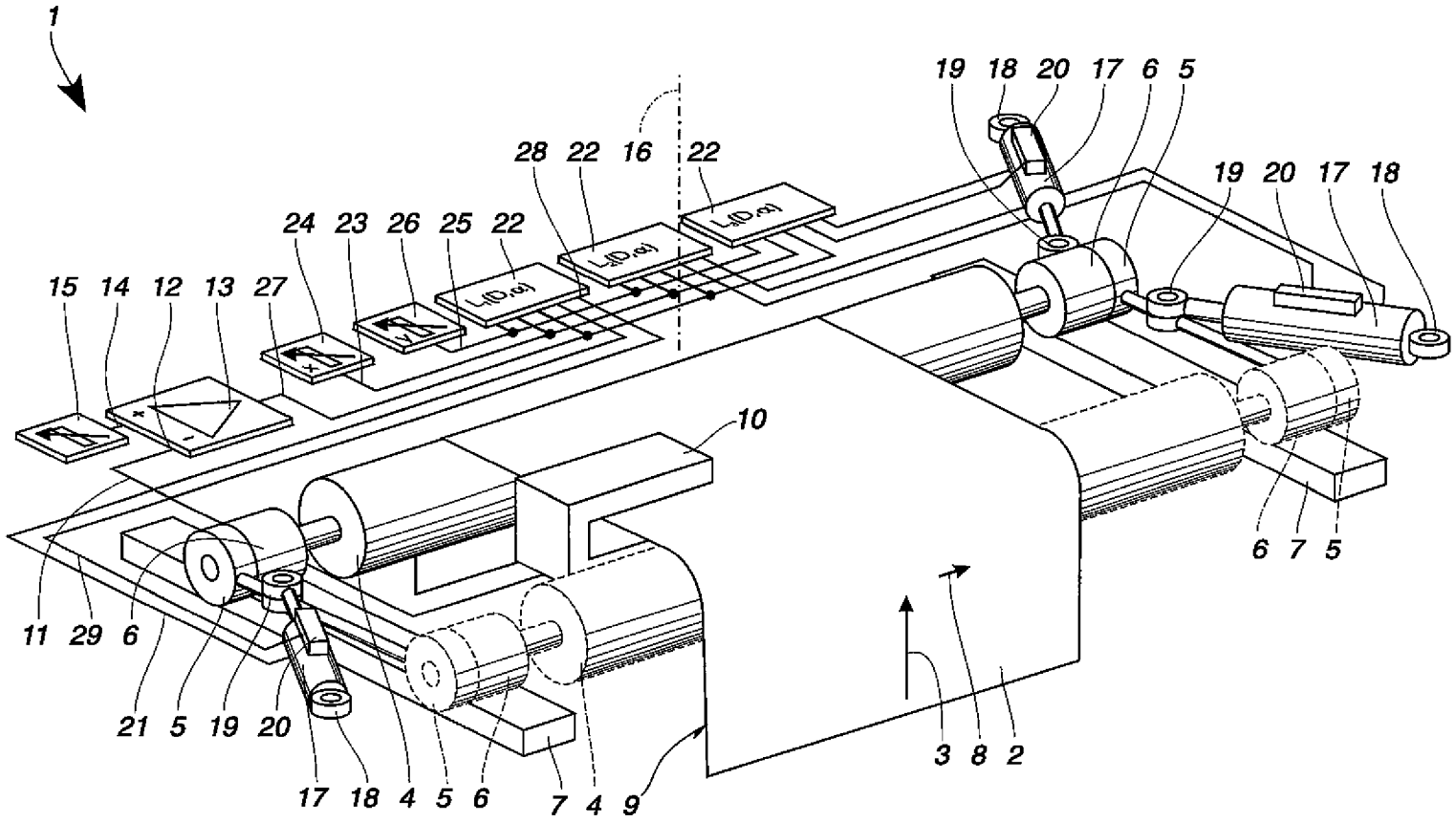

The present application claims priority to German Patent Application no: DE 10 2012 005 439.4, filed Mar. 20, 2012.

FIELD OF THE INVENTION

The invention relates to an apparatus for influencing a running material web

DESCRIPTION OF THE PRIOR ART

An apparatus is known from DE 100 22 926 C2. This apparatus has two rollers, which deflect a material web. The rollers are held rotatably in a common rotating frame. Twisting of the roller relative to the running direction of the web generates a transverse force, which is directed axially to the rollers and displaces the web. This apparatus can thus be used, for example, to regulate the web run. Given a suitable choice of pivot axis relative to the running direction of the web, an equalization of tension can also be realized in the material web transversely to the running direction of the web. In any event, the choice of position of the pivot axis of the rotating frame is of crucial importance to the control result. In order to bring the pivot axis as close as possible to the infeed of the material web, this printed document proposes to use a segmentally tailored roller bearing as the pivot axis. This apparatus has proved itself very well in practice and forms the basis of the present invention.

From DE 1 206 297 B, a strip position controller having a swivel roller is known. This pivoting roller is adjustable by means of two servo drives, which act on the same roller end. The pivoting roller is pivot-mounted in a bearing, so that the pivot axis is geometrically preset and is in no way adjustable.

From DE 695 28 224 T2, a web tensioner is known. This has a rotating frame, which is pivotable about two different axes. These axes are oriented orthogonally to each other, the position of the axes being fixed.

From DE 1 198 162 B, an adjusting device for a roller for the descaling of metal plates is known. This roller is adjusted on both sides by independent hydraulic cylinders. This roller can thus be both pivoted and displaced within preset limits. The driving of this roller is complicated, however, since the movement of each hydraulic cylinder results in both a pivot motion and a sliding motion of the roller.

DE 30 19 001 A1 discloses a roller of the generic type, which has independent actuating cylinders on both sides. Both actuating cylinders are coupled to each other by a pressure-equalizing device. This ensures that the same tensile force acts on both roller ends. An undefined adjustment of the roller is hereby obtained, however, so that this drive system is only suitable for dancer rollers. This printed document forms the basis of the present invention.

The object of the invention is to provide an apparatus of the type stated in the introduction, which apparatus, upon pivoting of the roller, produces improved web running characteristics for the material web.

This object is achieved according to the invention with the following features.

BRIEF SUMMARY OF THE INVENTION

The apparatus according to the invention serves to influence a running material web, wherein it is basically unimportant whether the apparatus influences the web run, the web tension or both. In any event, the apparatus has at least one adjustable roller, which deflects the material web. The at least one roller is hence wrapped through a certain angle by the material web. Only in this way can the at least one roller somehow influence the material web.

In order to improve the web running characteristics of the material web, it is proposed according to the invention to configure the at least one roller such that it is adjustable by at least two degrees of freedom. The at least one roller can have 2, 3, 4 or 5 degrees of freedom, according to requirement. Thus no fixed pivot axis, about which the at least one roller is pivotable, is any longer preset. In order that the roller nevertheless assumes a defined position during operation, it is operatively connected to at least two actuators. The actuators must here be arranged such that at least one of the actuators is assigned to each of the degrees of freedom. The position of the roller is thus defined as a function of the individual actuators. The at least one roller is hence no longer freely adjustable. This is important in order to obtain a defined reaction of the material web to the adjustment of the at least one roller. As a result of this measure, the adjustment of the roller can be realized very liberally, so that in particular an imaginary pivot axis is optionally adjustable within a preset range. In the case of asymmetrical web guidance, it is expedient, for example, to arrange the pivot axis not central to the roller, but central to the web. Where it is desired to influence the web run, this measure reduces secondary effects in relation to the web tension. It has transpired, moreover, that the optimal position of the pivot axis of the at least one roller lies at around ⅔ of the infeed length of the material web. This infeed length is dependent not only on the concrete installation situation, but also on the chosen operating mode of the upstream station. If the upstream station is capable, for example, of removing the last roller, viewed in the web running direction of the web, from the web run, then the infeed length of the downstream station is thereby altered. As a result of the multidimensional adjustability of the at least one roller without fixed pivot axis, allowance can be made for this alteration by simple offsetting of the imaginary pivot axis. This requires, in particular, no change in the mechanics and can therefore be conducted during current operation. There are also applications in which a web guiding device, according to the type of material web, will pass through once in the forward direction and once in the rearward direction. The web guiding device cannot generally be turned round. As a result of the variable pivot axis, the apparatus for influencing the running material web can in this case be adapted without difficulty to the altered direction of passage, without the need for mechanical changes.

Linearly adjustable drives have proved to be most suitable. It is in this case immaterial whether these actuators are hydraulically, pneumatically or electrically driven. It is merely important that, with the said actuators, a distance between two points on the actuator is adjustable, including counter to corresponding force action. Actuators of this type can easily be used in combination in order to adjust the at least one roller into the different degrees of freedom.

Since the actuators are intended to realize, apart from sliding motions, also pivot motions, it is important that these corresponding pivot motions do not jam. This can most easily be realized by both sides of the at least one actuator being held in pivot mountings. A first pivot mounting is here located on one side of the actuator, whilst a second pivot mounting on the second side of the actuator is connected to the at least one roller. It is here immaterial whether the first pivot mounting is fixed on the machine frame or is adjustable, for example, by further actuators. It is merely crucial that only one side of the actuator engages with the roller or its mounting.

A basic problem of the actuators is, however, that the motion of the roller, due to the actuator motion, is relatively complex and thus difficult to reproduce. It would generally be desirable that the at least one roller top executes a defined pivot motion through a preset pivot angle and about a preset imaginary pivot axis. The pivot angle is here regularly preset by a controller. The position of the pivot axis, as well as, where necessary, the direction thereof, is adapted however to the respective requirements. In order to achieve this in tandem with simple operability of the apparatus, it is proposed to connect at least one of the actuators to at least one computation circuit. This computation circuit calculates from the relative vectorial distance $\vec{A}$ of the first pivot mounting and the relative vectorial distance $\vec{B}$ of the second pivot mounting from a preset, imaginary pivot axis, and from a preset pivot angle $\alpha$ of the at least one roller, an actuator length L according to the following formula:

$$L = \sqrt{\vec{A}^2 + \vec{B}^2 + \vec{B}\left[\vec{A}^t\begin{pmatrix} -\cos(\alpha) & \sin(\alpha) \\ -\sin(\alpha) & \cos(\alpha) \end{pmatrix}\right]}$$

It should here be borne in mind that though the position of the second pivot mounting is basically dependent on the pivot angle of the at least one roller, the above formula should be taken to mean that the position of the second pivot mounting should be used for the non-pivoted roller ($\alpha=0$). Hence the vectors $\vec{A}$ and $\vec{B}$ are not dependent on the pivot angle $\alpha$. Though the above formula is relatively complicated, it can still be evaluated without difficulty during current operation by available microcontrollers. If a plurality of linearly acting actuators act on the at least one roller, then the above formula can be applied in materially the same way for each of these actuators. Only the values $\vec{A}$ and $\vec{B}$ have to be individually calculated for each individual actuator. In the above formula, it should be borne in mind that the "t" in respect of the vector $\vec{A}$ should be regarded as a transposition code. The vectors $\vec{A}$ and $\vec{B}$ are basically column vectors. The transposition gives rise to a line vector, which then, multiplied by the following modified rotation matrix, in turn produces a column vector. This column vector is then multiplied scalarly by the vector $\vec{B}$.

If the rotational symmetry of the at least one roller is taken into account, then this has 5 possible degrees of freedom. In the absence of further measures, at least 5 actuators would therefore be necessary to hold this roller in a defined position. This makes the apparatus complex, expensive and, at the same time, prone to faults. In general, however, there is no need at all for the roller to be adjustable by all 5 possible degrees of freedom. For simplification of the apparatus, it is therefore advantageous if the at least one roller is held in at least one guide. This guide restricts one or more degrees of freedom of the at least one roller, without the need for an additional actuator. If the apparatus is intended, for example, to correct the run of a material web, then the two degrees of freedom of the at least one roller are blocked in the direction of the angle bisector between the web infeed and the web outfeed by an appropriate guide. The functionality of the apparatus is not hereby impaired. If, on the other hand, the web tension transversely to the running direction of the web is intended to be influenced, degrees of freedom in the running direction of the web are meaningless and can be blocked by appropriate guides. The number of necessary actuators is thereby considerably reduced. In parallel to this, the complexity of the drive system for the apparatus as a whole is also reduced.

It is favourable if the at least one roller is operatively connected to at least one material web controller. This material web controller can regulate any chosen characteristics of the material web by pivoting of the at least one roller. If the at least one roller possesses a sufficient number of degrees of freedom, then influence can be exerted on a plurality of material web controllers, which regulate, on the one hand, the web run and, on the other hand, the web tension. These material web controllers in this case act on differently directed pivot axes of the at least one roller. The use of the at least one roller as a combined web run and web tension control roller, for example, is thus possible. In principle, the pivot axis for both pivot directions can here be individually freely chosen. It is also possible, however, to couple both pivot axes, which facilitates the adjustment.

It is favourable if the apparatus has at least one web edge sensor. This registers the position of a web edge of the material web. It is thus possible to correct the position of the web edge by pivoting of the at least one roller about the imaginary pivot axis. The pivot axis can thus be optionally adjusted in accordance with the requirements.

Alternatively or additionally, it is favourable, if the apparatus has at least two force sensors, which register the tensioning force differential of the material web across its width. Pivoting of the at least one roller then enables this tensioning force differential to be corrected.

BRIEF DESCRIPTION OF THE SEVERAL VIEWS OF DRAWINGS

Other advantages and characteristics of this invention will be explained in the detailed description below with reference to the associated figures that contain several embodiments of this invention. It should however be understood, that the figure is just used to illustrate the invention and does not limit the scope of protection of the invention.

Figure 2:
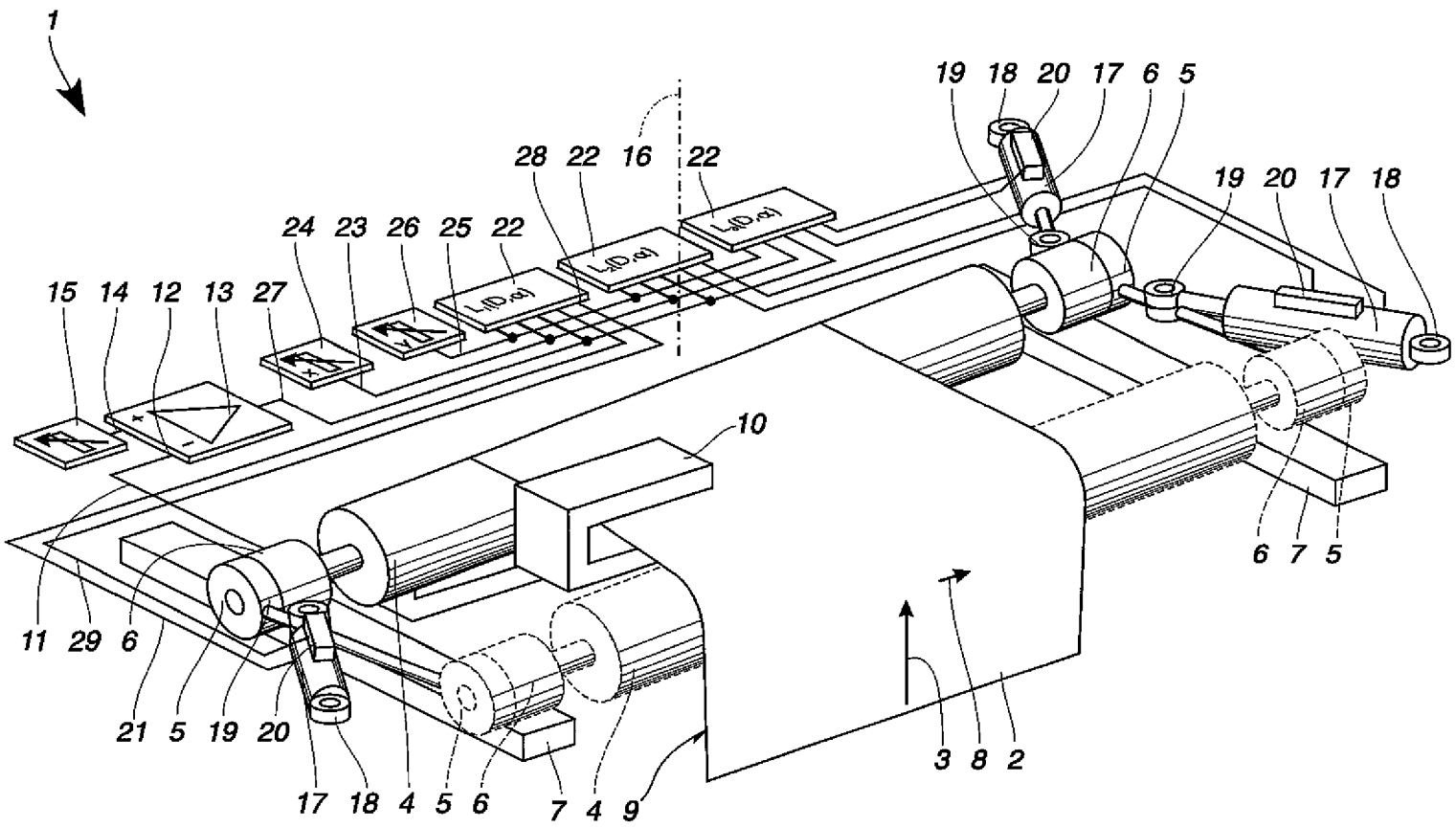
Figure 3:
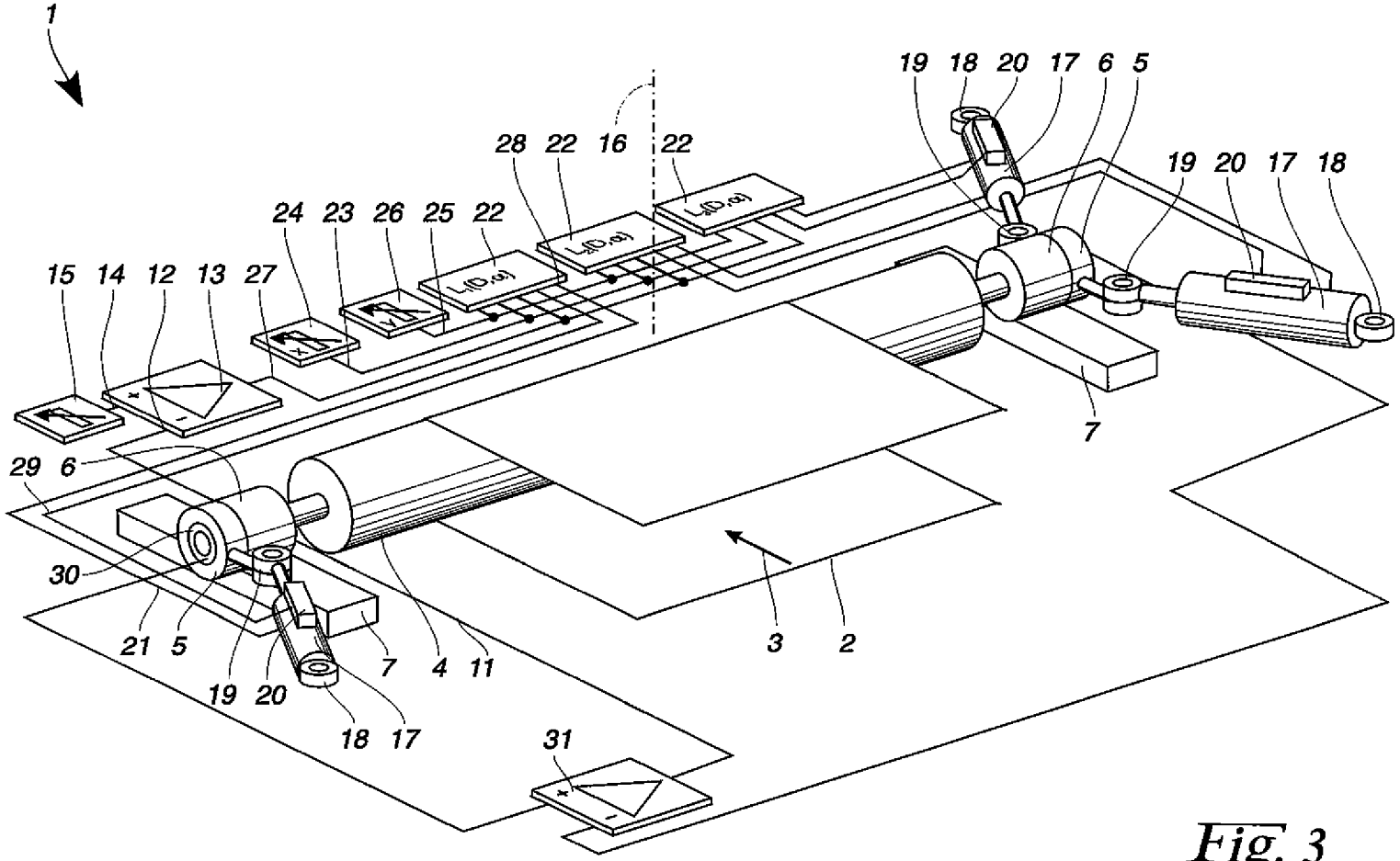
Figure 4:
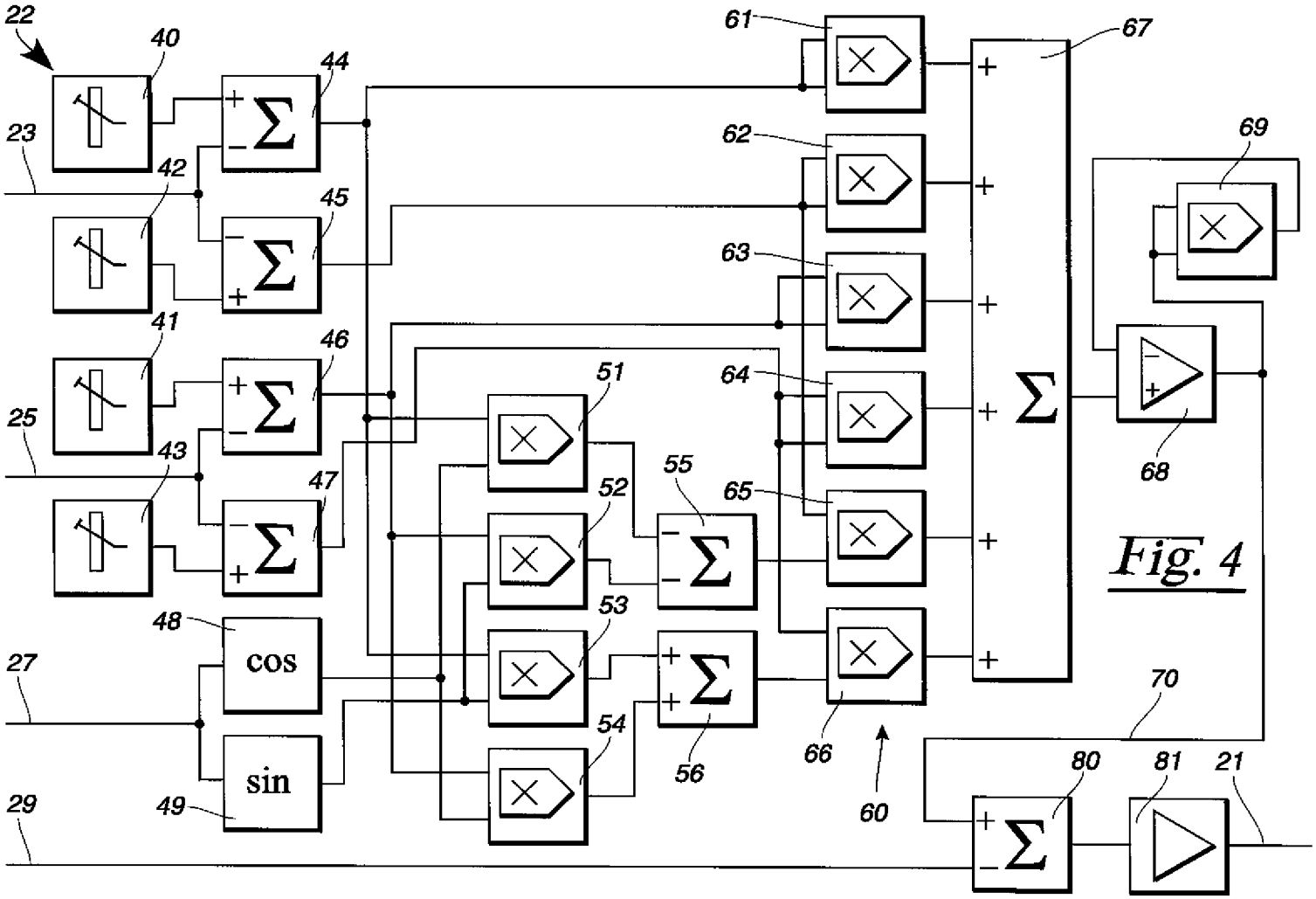

Wherein:

FIG. 1 shows an apparatus for influencing a running material web in an initial setting of a roller, FIG. 2 shows the apparatus according to FIG. 1 in the pivoted position of the roller, FIG. 3 shows an alternative embodiment of the apparatus according to FIG. 1, and FIG. 4 shows a preferred embodiment of a computation circuit for the driving of actuators.

DETAILED DESCRIPTION OF THE INVENTION

FIG. 1 shows a three-dimensional representation of an apparatus 1 for influencing a material web 2. The material web 2 possesses a running direction 3 and is deflected around at least one roller 4. In the illustrative embodiment according to FIG. 1, the rear one of the two rollers 4 is necessarily provided, whilst the front roller 4, drawn in dashed representation, is merely optional. According to the type of material web and the geometrical infeed and outfeed conditions of the material web 2, a single roller 4 can also suffice, so that the roller 4 shown in dashed representation can also be dispensed with.

The two rollers 4 are rotatably supported at the ends in roller bearings 5. It is here immaterial whether the rollers 4 are freely rotatably or are motor-driven. This choice is essentially dependent on the friction losses of the material web 2 as it is deflected around the roller 4.

Held on the rollers 4 by further roller bearings are rolls 6, which are guided in rolling arrangement on a guide 7. In principle, the rolls 6 can also be supported on the roller bearings 5, which leads, in particular, to reduced load upon the bearings. Moreover, instead of the rolls 6, slide shoes can also be attached directly to the roller bearings 5, which slide shoes slide along the guide 7. If the material web 2, in accordance with the representation in FIG. 1, is fed from below to the apparatus 1 and is led away downwards from this, then the tensile force of the material web 2 exerts solely a downwardly directed force component on the rollers 4. In this case, it is wholly sufficient to provide an appropriate guide 7 only beneath the rollers 6 or the alternative slide shoes. In particular, if alternative web courses are also intended to be allowed, it is necessary, where appropriate, to make the guide 7 double-sided, so that the rolls 6 reach into an appropriate free space of the guide 7 provided on the top side and bottom side of the rolls 6.

Although the material web 2 moves basically in the direction of the running direction 3, owing to external influences or inaccuracies in the alignments of rollers in upstream processing equipment, a slight transverse course 8 of the material web 2 is also obtained. In the absence of further measures, the material web 2 would be displaced beyond the roller ends, which would make further processing of the material web 2 impossible. For this purpose, the rollers 4 of the apparatus 1 are made adjustable. The adjustment of the rollers 4 is here realized such that a web edge 9 is held in a preset desired position. For this purpose, the apparatus 1 has a web edge sensor 10, which registers the position of the web edge 9 permanently or cylindrically and feeds it via a signal path 11 to an actual value input 12 of a material web controller 13. The material web controller 13 preferably has a P, PI or PID behaviour. The material web controller 13 additionally possesses a desired value input 14, which is operatively connected to a desired value transmitter 15.

In order to form a closed control loop, the material web controller 13 must be operatively connected to the rollers 4 such that the output signal of the material web controller 13 provokes an adjustment of the roller 4. It is known to connect the material web controller directly to an actuator which pivots the roller 4. In this case, however, the roller 4 would have to have a fixed pivot axis, thereby considerably restricting the applicability of the apparatus 1.

In order to enable not only the roller 4 to be pivotable, but also a pivot axis 16 to be variably adjustable, the roller 4 is adjustable by three degrees of freedom—two translatory and one pivotal degree of freedom. The roller is acted on by three actuators 17, which are configured, for example, in the form of hydraulic cylinders, pneumatic cylinders or electric servo drives. These actuators 17 respectively have a first pivot mounting 18 and a second pivot mounting 19. The first pivot mounting 18 is here configured fixed to a machine frame (not represented) and is therefore, in terms of its position, independent of the setting of the actuator 17. By contrast, the second pivot mounting 19 is connected to the roller bearings 5 of the roller 4 and is thus dependent, in terms of its position, on the actuator setting. By adjustment of the actuators 17, the distance of the first pivot mounting 18 from the second pivot mounting 19 changes, whereby the roller bearing 5 adjusts itself in accordance with the roller 4.

On each actuator 17 there is additionally provided a displacement transducer 20, which registers the respective setting of the actuator 17 and delivers this via a signal path 21.

To each actuator 17 is assigned a computation circuit 22. This computation circuit 22 is operatively connected via a signal path 23 to an X-value transmitter 24, which adjustably sets the X-coordinate of the pivot axis 16. Via a further signal path 25, the computation circuit 22 is operatively connected to a Y-value transmitter 26, which sets the Y-coordinate of the pivot axis 16. Via a further signal path 27, the computation circuit 22 receives the output signal of the material web controller 13. The signal paths 23, 25 and 27 are identical for all computation circuits 22, so that these are mutually connected in accordance with a parallel circuit. By contrast, the signal path 21 transmits the momentary position of the respective actuator 17 and is individual to each of the computation circuits 22. The computation circuits 22 respectively possess an output 28, which is connected to respectively one of the actuators 17 via, in each case, a signal path 29. The driving of the individual actuators 17 is thus calculated independently from one another in accordance with the presets of the material web controller 13 and of the X-value transmitter 24, as well as of the Y-value transmitter 26.

FIG. 2 shows the apparatus 1 according to FIG. 1 in the adjusted position of the rollers 4. The pivot axis 16 has here been used as a virtual axis, which is defined in terms of its position by no mechanics whatsoever. The pivoting of the roller 4 about the pivot axis 16 is realized only by appropriately coordinated driving of the actuators 17.

It is pointed out that the application of the apparatus 1 for regulating the web edge 9 of the material web 2 should be construed as merely illustrative. In principle, the apparatus 1 can influence the material web 2 in any chosen manner, insofar as this is possible by adjustment of at least one of the rollers 4. FIG. 3 shows an alternative embodiment of the apparatus 1 according to FIG. 1, wherein the same reference symbols denote the same parts. Instead of the web edge sensor 10, force sensors 30, which measure the bearing force of the roller 4, are provided in the roller bearings 5. Both force sensors 30 are operatively connected to a differential amplifier 31, which calculates the differential of the bearing forces at both roller ends and feeds this to the actual value input 12 of the material web controller 13. In this case, the apparatus 1 operates as a tension equalizing device in order to equalize tensions of the material web 2 which are formed transversely to its running direction 3. The web run of the material web 2 is chosen such that it has a greatest possible change in length upon adjustment of the roller 4. This is achieved by the material web departing from the horizontal direction, being deflected through 180° and being led off again in the horizontal direction. One roller 4 is here sufficient to regulate the tensioning force.

The computation circuits 22 are constructed identically to one another and are described by way of example with reference to the basic circuit diagram according to FIG. 4. The same reference symbols here denote the sane parts. The computation circuit 22 receives via the signal path 23 a signal proportional to the X-coordinate of the imaginary pivot axis 16. Via the signal path 25, it receives a signal proportional to the Y-coordinate of the pivot axis 16. The output signal of the material web controller 13 represents the necessary pivot angle of the rollers 4 and is fed to the computation circuit 22 via the signal path 27. Finally, the computation circuit 22 receives the signal of the displacement transducer 20 via the signal path 29. The computation circuit 22 calculates an output signal, which is fed via the signal path 21 to the actuators 17.

The computation circuit 22 has four value transmitters 40-43, the output signals of which represent the X- and Y-coordinates of the rest positions of the pivot mountings 18, 19. The value transmitter 40 here delivers the X-coordinate and the value transmitter 41 the Y-coordinate of the first pivot mounting 18, which is fixedly provided in the frame of the apparatus 1. By contrast, the value transmitter 42 delivers the X-coordinate and the value transmitter 43 the Y-coordinate of the rest position of the second pivot mounting 19, which is connected to the roller bearing 5 of the roller 4. As the rest position should here be understood that non-pivoted position of the roller 4 which is assumed by the at least one roller 4 when the signal at the signal path 27 is equal to zero. The roller 4 will assume this position only when no correction of the web run of the material web 2 is necessary.

Each of the value transmitters 40-43 is operatively connected to a non-inverting input of a differential amplifier 44-47. Inverting inputs of the differential amplifiers 44, 45 are operatively connected via the signal path 23 to the X-value transmitter 24 for determination of the X-coordinate of the pivot axis 16. By contrast, inverting inputs of the differential amplifiers 46, 47 are operatively connected via the signal path 25 to the Y-value transmitter 26 for determination of the Y-coordinate of the pivot axis 16. The differential amplifier 44 thus calculates the X-coordinate of the distance vector of the first pivot mounting 18 from the pivot axis 16. By contrast, the differential amplifier 45 determines the X-coordinate of the distance vector of the second pivot mounting 19 in the rest position of the roller 4 from the pivot axis 16. The differential amplifiers 46, 47 calculate the corresponding Y-coordinates of the two said vectors. An angle signal, which is fed from the material web controller 13 via the signal path 27 to the computation circuit 22, is fed, on the one hand, to a cosine generator 48 and, on the other hand, to a sine generator 49, which calculate from the signal arriving via the signal path 27 the cosine value and the sine value respectively.

The differential amplifiers 44, 46, which represent the X- and Y-coordinate of the first pivot mounting 18, are operatively connected, together with the output signals of the cosine generator 48 and sine generator 49, to multipliers 51-54. These multipliers 51-54 are here wired up such that any combination of output signals of the differential amplifiers 44, 46, on the one hand, and cosine generators 48 and sine generators 49, on the other hand, is multiplied. These multipliers 51-54 are operatively connected on the output side to two summing units 55, 56, the summing unit 55 being inverting and the summing unit 56 being non-inverting. These summing units 55, 56 determine the X-coordinate and the Y-coordinate of the product of the distance vector of the first pivot mounting 18 from the pivot axis 16 with a modified rotation matrix in the form:

$$\begin{pmatrix} -\cos(\alpha) & \sin(\alpha) \\ -\sin(\alpha) & \cos(\alpha) \end{pmatrix}$$

The said distance vector should here be regarded as a line vector and not as a column vector.

In a following step 60, multipliers 61-64 determine squares of the output signals of the differential amplifiers 44-47. Further multipliers 65, 66 determine a scalar product between the distance vector of the second pivot mounting 19 from the pivot axis 16 and the vector which is represented by output signals of the summing units 55, 56.

The output signals of all multipliers 61, 66 are next added in a summing unit 67 and fed to an operational amplifier 68. This operational amplifier 68 is linked back via a squarer 69, so that it calculates the square root of the output signal of the summing unit 67 and delivers it to a signal path 70. The signal at the signal path 70 here represents the required length of the associated actuator 17, i.e. the required distance of its first pivot mounting 18 from the second pivot mounting 19.

An output signal of the operational amplifier 68 is fed to a non-inverting input of a differential amplifier 80, the inverting input of which is connected via the signal path 29 to the displacement transducer 20 of the actuator 17. The differential amplifier 80 calculates an actual-desired value comparison and is operatively connected on the output side to a servo controller 81. This servo controller 81 preferably has a P, PI or PID behaviour and ensures that the position of the actuator 17 is regulated, so that this, regardless of generated forces, assumes a length as is preset as a signal on the signal path 70.

The described computation circuit 22 is relatively complex and is generally realized as a program of a microcontroller, thereby considerably reducing the wiring complexity. The description of this computation circuit as an analogue circuit makes understanding easier, however, since it can be effected, in particular, independently of program language. Each of the three computation circuits 22 is of basically identical construction, the signal paths 23, 25 and 27 of all computation circuits 22 additionally being connected to one another and having the same signals. The individual computation circuits 22 differ only by dint of the signal path 29 individually led up from the associated displacement transducer 20 and by dint of the adjustments of the value transmitters 40-43. On the output side, each computation circuit 22 is individually connected to a selected actuator 17.

As a result of these computation circuits 22, it is possible to drive each actuator 17 individually in such a way that the roller 4 assumes a pivot angle preset by the material web controller 13, the position of the pivot axis 16 being optionally presettable by the X-value transmitters 24 and Y-value transmitters 26. The position of the pivot axis 16 can here be changed even during current control operation.

Since some of the embodiments of this invention are not shown or described, it should be understood that a great number of changes and modifications of these embodiments is conceivable without departing from the rationale and scope of protection of the invention as defined by the claims.

REFERENCE SYMBOL LIST

| | |
|---|---|
| 1 | apparatus |
| 2 | material web |
| 3 | running direction |
| 4 | roller |
| 5 | roller bearing |
| 6 | roll |
| 7 | guide |
| 8 | transverse course |
| 9 | web edge |
| 10 | web edge sensor |
| 11 | signal path |
| 12 | actual value input |
| 13 | material web controller |
| 14 | desired value input |
| 15 | desired value transmitter |

-continued

| | |
|---|---|
| 16 | pivot axis |
| 17 | actuator |
| 18 | first pivot mounting |
| 19 | second pivot mounting |
| 20 | displacement transducer |
| 21 | signal path |
| 22 | computation circuit |
| 23 | signal path |
| 24 | X-value transmitter |
| 25 | signal path |
| 26 | Y-value transmitter |
| 27 | signal path |
| 28 | output |
| 29 | signal path |
| 30 | force sensor |
| 31 | differential amplifier |
| 40-43 | value transmitters |
| 44-47 | differential amplifiers |
| 48 | cosine generator |
| 49 | sine generator |
| 51-54 | multipliers |
| 55-56 | summing unit |
| 60 | step |
| 61-66 | multipliers |
| 67 | summing unit |
| 68 | operational amplifier |
| 69 | squarer |
| 70 | signal path |
| 80 | differential amplifier |
| 81 | servo controller |

The invention claimed is:

1. Apparatus for influencing a running material web, wherein said apparatus comprising:

at least one sensor, determining position or tension of said material web, at least one adjustable roller, which deflects said material web, wherein said at least one roller is adjustable by at least two degrees of freedom, at least one controller, being operatively connected with said at least one sensor, said at least one controller outputting a first signal representing a pivot angle α, at least two transmitters producing second signals, at least two actuators;

at least one computation circuit receiving said first signal representing said pivot angle α and said second signals being proportional to X- and Y-coordinates of an imaginary pivot axis, said at least one roller is operatively connected to said at least two actuators such that at least one of said actuators is assigned to each of said degrees of freedom, wherein at least one of said actuators is a linearly adjustable drive, having a first and a second end, being spaced apart from each other by an actuator length L said first end being pivotably held in a first pivot mounting and said second end being pivotably held in a second pivot mounting connected to said at least one roller said first pivot mounting in its unpivoted position having a relative vectorial distance $\vec{A}$ from said pivot axis, and said second pivot mounting in its unpivoted position having a relative vectorial distance $\vec{B}$ from said pivot axis, wherein said at least one actuator is operatively connected to said at least one computation circuit, said at least one computation circuit calculating said actuator length L from said relative, vectorial distances $\vec{A},\vec{B}$ from said pivot axis and from said pivot angle α of said at least one roller as follows $$(\alpha = 0°):\ L = \sqrt{\vec{A}^2 + \vec{B}^2 + \vec{B}\left[\vec{A}^t\begin{pmatrix} -\cos(\alpha) & \sin(\alpha) \\ -\sin(\alpha) & \cos(\alpha) \end{pmatrix}\right]}$$

wherein said at least one computation circuit acts on said at least one of said actuators to set the actuator length L to the calculated actuator length L provided by said computation circuit in order to control the running characteristics of the material web including the web run and/or the web tension.

2. Apparatus according to claim 1, wherein said at least one roller is held in at least one guide.

3. Apparatus according to claim 1, wherein said at least one controller is a material web controller, which is operatively connected to said at least one roller.

4. Apparatus according to claim 3, wherein said material web has a web edge having a position and said at least one sensor is a web edge sensor, which registers said position of said web edge and influences said at least one material web controller.

5. Apparatus according to claim 1, wherein said material web having a width and a tensioning force differential across said width of said material web, wherein said at least sensor comprises at least two force sensors, which register said tensioning force and influence said at least one material web controller.

6. Apparatus according to claim 3, wherein said material web having a width and a tensioning force differential across said width of said material web, wherein said at least one sensor comprises at least two force sensors, which register said tensioning force and influence said at least one material web controller.

* * * * *